US006740627B1

(12) United States Patent
Clarke et al.

(10) Patent No.: US 6,740,627 B1
(45) Date of Patent: May 25, 2004

(54) DIOLS AND POLYMERIC GLYCOLS IN DISHWASHING DETERGENT COMPOSITIONS

(75) Inventors: Joanna Margaret Clarke, Brussels (BE); Garry Kenneth Embleton, Grimberger (BE); Howard David Hutton, Loveland, OH (US); Mark Leslie Kacher, Mason, OH (US); John David Sadler, Cincinnati, OH (US); Deborah Pancheri Wallace, Montgomery, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/890,672

(22) PCT Filed: Feb. 8, 2000

(86) PCT No.: PCT/US00/03231

§ 371 (c)(1),
(2), (4) Date: Aug. 3, 2001

(87) PCT Pub. No.: WO00/46331

PCT Pub. Date: Aug. 10, 2000

Related U.S. Application Data

(60) Provisional application No. 60/119,044, filed on Feb. 8, 1999.

(51) Int. Cl.[7] ..... C11D 3/30; C11D 3/37; C11D 3/20; C11D 1/94; B08B 3/04

(52) U.S. Cl. ..... 510/221; 510/226; 510/237; 510/392; 510/413; 510/421; 510/426; 510/433; 510/475; 510/514; 134/25.2; 134/25.3; 134/39; 134/40; 134/42

(58) Field of Search ..... 510/221, 226, 510/237, 372, 413, 421, 426, 433, 475, 514; 134/25.2, 25.3, 39, 40, 42

(56) References Cited

U.S. PATENT DOCUMENTS

| | | | | | |
|---|---|---|---|---|---|
| 5,356,800 | A | | 10/1994 | Jaquess | |
| 5,990,065 | A | * | 11/1999 | Vinson et al. | 510/237 |
| 6,069,122 | A | * | 5/2000 | Vinson et al. | 510/235 |
| 6,207,631 | B1 | * | 3/2001 | Kasturi et al. | 510/237 |
| 6,521,577 | B1 | * | 2/2003 | Ofosu-Asante et al. | 510/237 |
| 2002/0132747 | A1 | * | 9/2002 | Huyhn et al. | 510/218 |
| 2002/0177539 | A1 | * | 11/2002 | Kasturi et al. | 510/235 |

FOREIGN PATENT DOCUMENTS

| | | | | |
|---|---|---|---|---|
| EP | 0 449 503 A2 | | 10/1991 | |
| EP | WO 98/28393 | * | 7/1998 | C11D/3/30 |
| EP | WO 00/46330 | * | 8/2000 | C11D/3/30 |
| EP | WO 00/46331 | * | 8/2000 | C11D/3/30 |
| GB | 2 322 380 A | | 8/1998 | |
| WO | WO 96/12000 | | 4/1996 | |
| WO | WO 98/28393 | | 7/1998 | |

* cited by examiner

*Primary Examiner*—Brian P. Mruk
(74) *Attorney, Agent, or Firm*—Richard S. Echler, Sr.; Kevin L. Waugh

(57) ABSTRACT

Disclosed are detergent compositions comprising organic diamines, anionic surfacants and amphoteric surfactants including amine oxide for hand dishwashing which, by incorporating certain organic solvents, results in a liquid dishwashing detergent composition that is not only a more effective cleaning agent, but also offers improved physical and enzymatic stability and more convenient rheology and handling characteristics than typical liquid dishwashing compositions.

19 Claims, No Drawings

DIOLS AND POLYMERIC GLYCOLS IN DISHWASHING DETERGENT COMPOSITIONS

The present application is a 371 of PCT/US00/03231 filed Feb. 8, 2000, which claims benefit of U.S. Provisional Application Serial No. 60/119,044 filed Feb. 8, 1999.

TECHNICAL FIELD

The present invention relates to liquid or gel dishwashing detergent compositions suitable for use in manual dishwashing operations. These compositions contain amphoteric and anionic surfactants, organic diamines, and solvents selected from the group consisting of diols and polymeric glycols and mixtures thereof as well as other detergent adjuvants. These components, in the combinations disclosed herein, serve to impart preferred food soil cleaning, handling and sudsing characteristics to such dishwashing detergent products.

BACKGROUND OF THE INVENTION

Light-duty liquid (LDL) or gel detergent compositions useful for manual dishwashing are well known in the art. Such products are generally formulated to provide a number of widely diverse performance and aesthetics properties and characteristics. First and foremost, liquid or gel dishwashing products must be formulated with types and amounts of surfactants and other cleaning adjuvants that will provide acceptable solubilization and removal of food soils, especially greasy soils, from dishware being cleaned with, or in aqueous solutions formed from such products. Thus, there is a continuing effort by formulators of liquid dishwashing compositions to incorporate additional components into LDL detergents to provide consumers with improved cleaning benefits.

Second, liquid dishwashing products must be formulated to be physically stable and free of adverse heterogeneity. "Physical stability" in this sense refers to the tendency of a liquid composition to remain as a homogeneous solution rather than having one or more components precipitate (if the discontinuous phase is a solid) or separate (if the discontinuous phase is a liquid) out of the liquid. Thus, a useful detergent composition is one that is free of inhomogeneties and is stable under a variety of different service conditions and storage temperatures—previous formulators have found cold temperature stability particularly difficult to obtain. Physical stability not only enhances the appearance and hence the consumer perception of the product, but is also essential to providing effective cleaning performance.

Third, liquid dishwashing products should be formulated to have a viscosity that makes the use of the product convenient and practicable. Thus, a liquid dishwashing composition should not be so thick that it cannot be easily poured out of its container and at the same time not so thin that it is difficult to concentrate onto the surface of a sponge or kitchen article. Liquid dishwashing compositions should also have a favorable "dilution profile", meaning that as the liquid dishwashing product is further diluted with water, the composition decreases in viscosity. This is in contrast to how many typical liquid dishwashing compositions behave, in which compositions upon first aqueous dilution become more viscous, thus making them not only more difficult to use but also impairing their dissolution. "Dissolution" is another important attribute of liquid dishwashing products. By dissolution is meant the rate at which the liquid dishwashing product mixes with water. Generally it is preferable that a detergent product mix quickly with water so that its detersive benefits are immediately available to the consumer, thus minimizing the amount of time he or she must devote to cleaning tasks.

Fourth, special care has to be taken in formulating liquid dishwashing products which include enzymes so that the enzymes are not degraded or decomposed by their interaction with other detergent ingredients. Enzymes are important components of dishwashing compositions because they offer improved cleaning benefits on proteintased soils and have also been shown to provide consumers with a mildness or skin feel/appearance advantage over other similar detergent compositions which do not contain enzymes. However, it can be difficult to incorporate enzymes into liquid dishwashing compositions because they are unstable in the presence of many standard LDL ingredients, such as citric acid. Also because enzymes are active in the presence of water and because most liquid dishwashing compositions are aqueous, care must be taken that the enzymes are not activated during storage and thus depleted by the time the LDL composition is ready for use.

Given the foregoing, there is a continuing need to formulate manual dishwashing liquids that provide excellent cleaning benefits, have stable formulations over a broad temperature range, and yet have a viscosity and consistency so that they are useful and convenient for a manual dishwashing operation. Accordingly, it is a benefit of the present invention to provide light-duty liquid dishwashing compositions which not only provide improved cleaning benefits, but are also of a convenient consistency and viscosity, are colorless and odorless, stable and serviceable under a broad range of service temperatures and have improved enzyme stability over existing liquid dishwashing composition formulations.

SUMMARY OF THE INVENTION

It has now been determined that the use of a solvent selected from the group consisting of certain diols, certain polymeric glycols and mixtures thereof, as outlined in detail below, in combination with amphoteric surfactants, anionic surfactants and organic diamines in a specific ratio provides superior cleaning, grease cutting, physical stability, dissolution and theological behavior over typical liquid dishwashing compositions. In particular it has been found that the addition of diols can improve the physical and enzymatic stability of a liquid dishwashing composition. The diols prepared according to the present invention and described in greater detail below have been shown to improve the physical stability of liquid dishwashing compositions even at high pHs (above 10.0) and low temperatures where typically it is likely that certain components will separate out from the composition solution and form inhomogeneities. These diols have also been shown to improve enzymatic stability even in compositions with high water levels.

Moreover, these diols, like other solvents, provide stabilizing benefits to dishwashing compositions, but unlike other solvents (e.g. ethanol), do not thin the dishwashing compositions in which they are included. This allows a formulator to stabilize dishwashing compositions over a greater range of viscosities, because the diols provide formula stability benefits without the corresponding cost of decreasing formula viscosity.

Additionally it has been found that the addition of certain polymeric glycols, particularly in combination with sodium chloride or other alkali metal inorganic salts, can improve the dilution profile and low temperature stability of a LDL detergent composition.

The detergent compositions according to the first aspect of the present invention comprise: (a) a low molecular weight organic diamine having a pK1 and a pK2, wherein the pK1 and the pK2 of said diamine are both in the range of from about 8.0 to about 11.5; (b) an anionic surfactant; (c) an amphoteric surfactant; and (d) a solvent selected from the group consisting of diols, polymeric glycols and mixtures thereof; wherein said diol is selected from the group consisting of:

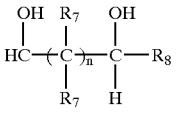

wherein n=0–3, $R_7$=H, methyl or ethyl; and $R_8$=H, methyl, ethyl, propyl, isopropyl, butyl and isoubutyl; and wherein the polymeric glycol is selected from the group consisting of:

$$(PO)_x(EO)_yH$$

wherein PO represents a propylene oxide group and EO represents an ethylene oxide group and x+y is from about 17 to 68, and x/(x+y) is from about 0.25 to 1.0;

The pH (as measured as 10% aqueous solution) is from about 5.0 to about 12.5 and the mole ratio of said anionic surfactant to said amphoteric surfactant to said diamine is from about 100:40:1 to about 9:0.5:1.

In accordance with a second aspect of the present invention, a detergent composition suitable for use in hand dishwashing, said composition comprising: (a) from about 0.1% to about 5%, by weight of a diamine having a molecular weight less than or equal to 400 g/mol; (b) from about 5% to about 50%, by weight, of an anionic surfactant; (c) from about 0.5% to about 10%, by weight, of an amphoteric surfactant; (d) from about 0.0001% to about 5%, by weight, of an enzyme; (e) from about about 0.75% to about 25.0%, by weight, of a solvent selected from the group consisting of diol, polymeric glycol and mixtures thereof, the diols and polymeric glycols being those described above in the paragraph on the first aspect of the invention. The detergent composition also includes: (f) from about 0.01% to about 5%, by weight, of a polymeric suds stabilizer selected from the group consisting of:

i) homopolymers of (N,N-dialkylamino)alkyl acrylate esters having the formula:

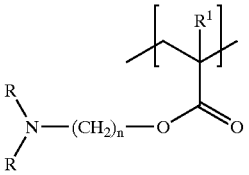

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6;

ii) copolymers of (i) and

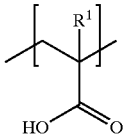

wherein $R^1$ is hydrogen, C1–C6 alkyl, and mixtures thereof; provided that the ratio of (ii) to (i) is from about 2 to 1 to about 1 to 2; and wherein said polymeric suds stabilizer has a molecular weight of from about 1,000 to about 2,000,000 daltons; and iii) mixtures thereof.

The pH (as measured as 10% aqueous solution) is from about 5.0 to about 12.5 and wherein mole ratio of said anionic surfactant to said amphoteric surfactant to said diamine is from about 27:8:1 to about 11:3:1.

According to a third aspect of the present invention a detergent composition suitable for use in hand dishwashing, the composition comprising: (a) from about 0.1% to about 5%, by weight, of an organic diamine having a molecular weight less than or equal to 400 g/mol (b) from about 5% to about 50%, by weight, of an anionic surfactant; (c) from about 0.5% to about 10%, by weight, of an amphoteric surfactant; (d) from about 0.1% to about 10.0%, by weight, of a buffering agent; (e) from about 0.1% to about 1.5%, by weight, of an alkali metal inorganic salt; and (f) from about about 0.75% to about 25.0%, by weight, of a solvent selected from the group consisting of diol, polymeric glycol and mixtures thereof; the diols and polymeric glycols being those described above. The pH (as measured as 10% aqueous solution) is from about 10 to about 12 and the mole ratio of said anionic surfactant to said amphoteric surfactant to said diamine is from about 27:8:1 to about 11:3:1.

All parts, percentages and ratios used herein are expressed as percent weight unless otherwise specified. All documents cited are, in relevant part, incorporated herein by reference.

DETAILED DESCRIPTION OF THE INVENTION

Definitions—The present detergent compositions comprise an "effective amount" or a "grease removal-improving amount" of individual components defined herein. By an "effective amount" of the diamines herein and adjunct ingredients herein is meant an amount which is sufficient to improve, either directionally or significantly at the 90% confidence level, the performance of the cleaning composition against at least some of the target soils and stains. Thus, in a composition whose targets include certain grease stains, the formulator will use sufficient diamine to at least directionally improve cleaning performance against such stains.

By "ethylene oxide group" it is meant the following structure:

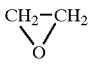

By "propylene oxide group" it is meant the following structure:

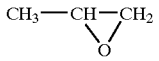

By "light-duty liquid (LDL) detergent composition" it is meant a detergent composition which is employed in manual (i.e. hand) dishwashing.

The present liquid detergent compositions contain either diols or polymeric glycols or a mixture of both diols and polymeric glycols. Diols suitable for use in the present invention have the following formula:

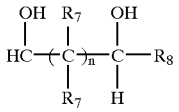

wherein n=0–3, $R_7$=H, methyl or ethyl; and $R_8$=H, methyl, ethyl, propyl, isopropyl, butyl and isoubutyl. Preferred diols include propylene glycol, 1,2 hexanediol, 2-ethyl-1,3-hexanediol and 2,2,4-trimethyl-1,3-pentanediol. When diols are present, the present compositions will comprise at least about 0.5%, more preferably at least about 1%, even more preferably still, at least about 3% by weight of the composition of diols. The composition will also preferably contain no more than about 20%, more preferably no more than about 10%, even more preferably, no more than about 6% by weight of the composition of diols.

Polymeric glycols, which comprise ethylene oxide (EO) and propylene oxide (PO) groups may also be included in the present invention. These materials are formed by adding blocks of ethylene oxide moieties to the ends of polypropylene glycol chains. Polymeric gycols suitable for use in the present invention are of the following formula:

$$(PO)_x(EO)_yH$$

wherein x+y is from about 17 to 68, and x/(x+y) is from about 0.25 to 1.0. A preferred polymeric glycol is a polyproylene glycol (corresponding to when y≈0) having an average molecular weight of between about 1000 to about.5000, more preferably between about 2000 to about 4000, most preferably about 2000 to about 3000.

When polymeric glycols are present the present liquid detergent compositions will contain at least about 0.25%, more preferably at least about 0.5%, even more preferably still, at least about 0.75% by weight of the composition of polymeric glycols. The composition will also preferably contain no more than about 5%, more preferably no more than about 3%, even more preferably, no more than about 2% by weight of the composition.

To insure satisfactory physical stability, whenever polymeric glycols are added to a liquid dishwashing composition, it may be necessary to also include either a diol and/or an alkali metal inorganic salt, such as sodium chloride. Suitable amounts of diols to provide physical stability are in the amounts in the ranges found above, while a suitable amount of an alkali metal inorganic salt is at least about 0.1% and less than about 1.5%, preferably less than about 0.8% by weight of the composition.

As discussed above, the addition of diols can improve the physical and enzymatic stability of a liquid dishwashing composition. Of particular importance to the present invention is that diols provide important stabilizing benefits to certain polymer suds stabilizers and enzymes. Both polymer suds stabilizers and enzymes can provide important benefits by their incorporation.

Without being limited by theory, it is believed that diols provide enzyme stabilizing benefits by limiting the activity of enzymes in the liquid dishwashing composition during storage. Enzymes require water for optimal performance, thus deactivation is accomplished by reducing the amount of free water interacting with the enzyme by displacing a portion of the water with the diols described above which are completely miscible with water. Upon use, the liquid dishwashing composition is significantly diluted with water, thus providing the enzyme with a water environment conducive to optimal activity and performance.

It is also believed, again without being limited by theory, that the physical stability benefits of diols and polymeric glycols come from their ability to act as an hydrotrope. By maintaining the phase stability of the composition, even at low temperatures, certain components, particularly certain polymers, are prevented from precipitating out of the composition and forming a multiphase LDL composition.

Thus, the present invention includes a carrier/solvent system which may consist of one or more of the following ingredients: diols and polymeric glycols as described above, water, alkali metal inorganic salts and one or more of the conventional solvents disclosed below.

Conventional Solvents—In addition to propylene glycol and polypropylene glycol, a variety of other water-miscible liquids such as lower alkanols, diols, other polyols, ethers, amines, and the like may be used in the present invention. Particularly preferred are the C1–C4 alkanols.

When present the composition will preferably contain at least about 0.01%, more preferably at least about 0.5%, even more preferably still, at least about 1% by weight of the composition of solvent. The composition will also preferably contain no more than about 20%, more preferably no more than about 10%, even more preferably, no more than about 8% by weight of the composition of solvent.

These solvents may be used in conjunction with an aqueous liquid carrier, such as water, or they may be used without any aqueous liquid carrier being present. Solvents are broadly defined as compounds that are liquid at temperatures of 20° C.–25° C. and which are not considered to be surfactants. One of the distinguishing features is that solvents tend to exist as discrete entities rather than as broad mixtures of compounds. Examples of suitable solvents for the present invention include ethanol, propanol, isopropanol, 2-methyl pyrrolidinone, benzyl alcohol and morpholine n-oxide. Preferred among these solvents are ethanol and isopropanol.

Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Besides propylene glycol, polypropylene glycol and the diols illustrated above, other glycols according to the formula: HO—CR1R2—OH wherein R1 and R2 are independently H or a C2–C10 saturated or unsaturated aliphatic hydrocarbon chain and/or cyclic are suitable and can be used herein. One such suitable glycol is dodecaneglycol.

Suitable alkoxylated glycols which can be used herein are according to the formula $$R—(A)_n—R^1—OH$$

wherein R is H, OH, a linear saturated or unsaturated alkyl of from 1 to 20 carbon atoms, preferably from 2 to 15 and more preferably from 2 to 10, wherein $R^1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable aromatic alcohols which can be used herein are according to the formula ROH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R (A)n-OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable linear C1–C5 alcohols which can be used herein are according to the formula R—OH wherein R is a linear saturated or unsaturated alkyl group of from 1 to 5 carbon atoms, preferably from 2 to 4. Suitable linear $C_1$–$C_5$ alcohols are methanol, ethanol, propanol or mixtures thereof.

Other suitable solvents include, but are not limited to, butyl diglycol ether (BDGE), butyltriglycol ether, ter amilic alcohol and the like. Particularly preferred solvents which can be used herein are butoxy propoxy propanol, butyl diglycol ether, benzyl alcohol, butoxypropanol, ethanol, methanol, isopropanol and mixtures thereof.

Other suitable solvents for use herein include propylene glycol derivatives such as n-butoxypropanol or n-butoxypropoxypropanol, water-soluble CARBITOL R™ solvents or water-soluble CELLOSOLVE R™ solvents; water-soluble CARBITOL R™ solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE R™ solvents are compounds of the 2-alkoxyethoxy ethanol class, with 2-butoxyethoxycthanol being preferred. Other suitable solvents include benzyl alcohol, and diols such as 2-ethyl-1,3 hexanediol and 2,2,4 trimethyl-1,3-pentanediol and mixtures thereof. Some preferred solvents for use herein are n-butoxypropoxypropanol, butyl CARBITOL™, and mixtures thereof.

The solvents can also be selected from the group of compounds comprising ether derivatives of mono-, di- and tri-ethylene glycol, butylene glycol ethers, and mixtures thereof. The molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "DOWANOL™" glycol, and from the Arco Chemical Company under the tradename "ARCOSOLV™" glycol. Other preferred solvents including mono- and di-ethylene glycol n-hexyl ether are available from the Union Carbide Company.

Diamines—As noted above, the diamines used herein in detergent compositions in combination with detersive surfactants at levels which are effective for achieving at least a directional improvement in cleaning performance. In the context of a hand dishwashing composition, such "usage levels" can vary depending not only on the type and severity of the soils and stains, but also on the wash water temperature, the volume of wash water and the length of time the dishware is contacted with the wash water.

Since the habits and practices of the users of detergent compositions show considerable variation, the composition will preferably contain at least about 0.1%, more preferably at least about 0.2%, even more preferably, at least about 0.25%, even more preferably still, at least about 0.5% by weight of said composition of diamine. The composition will also preferably contain no more than about 15%, more preferably no more than about 10%, even more preferably, no more than about 6%, even more preferably, no more than about 5%, even more preferably still, no more than about 1.5% by weight of said composition of diamine.

In one of its several aspects, this invention provides a means for enhancing the removal of greasy/oily soils by combining the specific diamines of this invention with surfactants. Greasy/oily "everyday" soils are a mixture of triglycerides, lipids, complex polysaccharides, fatty acids, inorganic salts and proteinaceous matter.

Thus diamines, in combination with amphoteric and anionic surfactants in the specific ratios discussed below, offer the benefit of improved grease and tough food cleaning which allows the elimination or reduction in the amount of divalent ions in the preferred embodiments of the present formula. This improved cleaning is a result of diamines' proclivity as a buffering agent to increase the alkalinity of the dishwashing composition. The superior rate of dissolution achieved by divalent ion elimination even allows the formulator to make hand dishwashing detergents, especially compact formulations, at even significantly higher viscosities (e.g., 1,000 centipoise or higher) than conventional formulations while maintaining excellent dissolution and cleaning performance. This has significant potential advantages for making compact products with a higher viscosity while maintaining acceptable dissolution. By "compact" or "Ultra" is meant detergent formulations with reduced levels of water compared to conventional liquid detergents. For "compact" or "Ultra" formulations, the level of water is less than 50%, preferably less than 30% by weight of the liquid dishwashing detergent compositions. Said concentrated products provide advantages to the consumer, who has a product which can be used in lower amounts and to the producer, who has lower shipping costs. For compositions which are not meant to be concentrated, a suitable water level is less than about 85%, more preferably less than about 70% by weight of the liquid dishwashing detergent compositions.

It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation.

As is discussed in greater detail below, making the compositions free of hydrogen peroxide is important when the compositions contain an enzyme. Even small amounts of hydrogen peroxide can cause problems with enzyme containing formulations. However, the diamine can react with any peroxide present and act as an enzyme stabilizer and prevent the hydrogen peroxide from reacting with the enzyme. The only draw back of this stabilization of the enzymes by the diamine is that the nitrogen compounds produced are believed to cause the malodors which can be present in diamine containing compositions. Having the diamine act as an enzyme stabilizer also prevents the diamine from providing the benefits to the composition for which it was originally put in to perform, namely, grease cleaning, sudsing, dissolution and low temperature stability. Therefore, it is preferred to minimize the amount of hydrogen peroxide present as an impurity in the inventive compositions either by using components which are substantially free of as an enzyme stabilizer, because of the possible generation of hydrogen peroxide and/or by using non-diamine antioxidants even though the diamine can act malodorous compounds and the reduction in the amount of diamine available present to perform its primary role.

Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis (methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP™ organic diamine) (pK1=10.5; pK2=8.9), 2-methyl 1,5 pentane diamine (DYTEK A™ organic diamine) (pK1=11.2; pK2=10.0). Other preferred materials are the primary/primary diamines with aklylene spacers ranging from C4 to C8. In general, it is believed that primary diamines are preferred over secondary and tertiary diamines.

Definition of pK1 and DK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, New York and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, New York, 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., JEFFAMINE EDR 148™ organic diamine). In addition, materials based on ethylene diamine are unsuitable.

The diamines useful herein can be defined by the following structure:

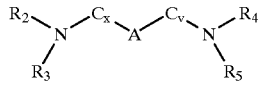

wherein $R_{2-5}$ are independently selected from H, methyl, —$CH_3CH_2$, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Examples of preferred diamines can be found in the copending provisional patent application of Phillip Kyle Vinson et al., entitled "Dishwashing Detergent Compositions Containing Organic Diamines for Improved Grease Cleaning, Sudsing, Low Temperature Stability and Dissolution", having P & G Case No. 7167P, application serial No. 60/087,693, and filed on Jun. 2, 1998, which is hereby incorporated by reference.

Anionic Surfactants—The anionic surfactants useful in the present invention are preferably selected from the group consisting of linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof. An effective amount, typically from about 0.5% to about 90%, preferably about 5% to about 50%, more preferably from about 10 to about 30%, by weight of anionic detersive surfactant can be used in the present invention.

Suitable examples of anionic surfactants may be found in copending provisional patent application of Chandrika Kasturi et al., entitled "Liquid Detergent Compositions Comprising Polymeric Suds Enhancers", having P & G Case No. 6938P, serial No. 60/066,344 and filed on Nov. 21, 1997, which is hereby incorporated by reference. Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23. Suitable anionic surfactants may further be found in U.S. Pat. No. 5,415,814 issued 16 May 1995, to Ofosu-Asante et al., all of which are hereby incorporated by reference.

Amphoteric surfactants—The amphoteric surfactants useful in the present invention are preferably selected from amine oxide surfactants. Amine oxides are semi-polar nonionic surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

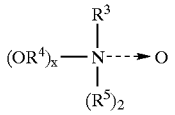

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Also suitable are amine oxides such as propyl amine oxides, represented by the formula:

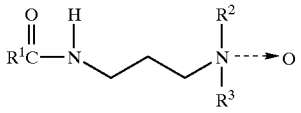

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10.

A further suitable species of amine oxide semi-polar surface active agents comprise compounds and mixtures of compounds having the formula:

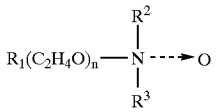

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl isopropyl, 2-hydroxyethyl, 2-hydroxypropyl, or 3-hydroxypropyl and n is from 0 to about 10. Particularly preferred are amine oxides of the formula:

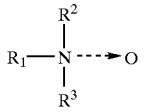

wherein $R_1$ is a $C_{10-14}$ alkyl and $R_2$ and $R_3$ are methyl or ethyl. Because they are low-foaming it may also be desirable to use long chain amine oxide surfactants which are more fully described in U.S. Pat. Nos. 4,316,824 (Pancheri), 5,075,501 and 5,071,594, incorporated herein by reference.

Other suitable, non-limiting examples of amphoteric detergent surfactants that are useful in the present invention include amido propyl betaines and derivatives of aliphatic or heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Further examples of suitable amphoteric surfactants are given in "Surface Active Agents and Detergents" (Vol. I and II by Schwartz, Perry and Berch), hereby incorporated by reference.

Preferably the amphoteric surfactant is present in the composition in an effective amount, more preferably from about 0.1% to about 20%, even more preferably about 0.1% to about 15%, even more preferably still from about 0.5% to about 10%, by weight.

Secondary Surfactants—Secondary detersive surfactant can be selected from the group consisting of nonionics, cationics, ampholytics, zwitterionics, and mixtures thereof. By selecting the type and amount of detersive surfactant, along with other adjunct ingredients disclosed herein, the present detergent compositions can be formulated to be used in the context of laundry cleaning or in other different cleaning applications, particularly including dishwashing. The particular surfactants used can therefore vary widely depending upon the particular end-use envisioned. Suitable secondary surfactants are described in detail in the copending provisional patent application of Chandrika Kasturi et al., entitled "Liquid Detergent Compositions Comprising Polymeric Suds Enhancers", having P & G Case No. 6938P, application serial No. 60/066,344, incorporated above.

Ratio of Anionic to Amphoteric to Diamine

In the compositions of the present invention the ratio of the anionic surfactant; amphoteric: diamine is from about 100:40:1 to about 9:0.5:1, by mole, preferably the ratio of the anionic surfactant: amphoteric: diamine is from about 27:8:1 to about 11:3:1, by mole. It has been found that detergent compositions containing anionic surfactant, amphoteric surfactant and diamine in this specific ratio range provide improved low temperature stability, deliver better grease removal and tough food cleaning benefits at pH less than 12.5, and improved hard water cleaning.

In another aspect of the present invention the mole ratio of anionic surfactant to diamine of greater than 9:1, preferably greater than 20:1, has been found to give improved low temperature stability, deliver better grease removal and tough food cleaning benefits and improved hard water cleaning.

OPTIONAL DETERGENT INGREDIENTS

Polymeric Suds Stabilizer—The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

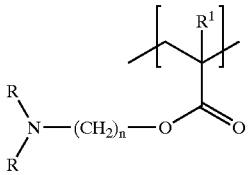

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

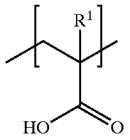

wherein $R^1$ is hydrogen, C1–C6 alkyl, and mixtures thereof, provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

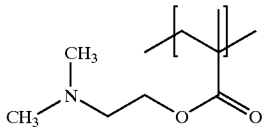

When present in the compositions, the polymeric suds booster may be present in the composition from about 0.01% to about 15%, preferably from about 0.05% to about 10%, more preferably from about 0.1% to about 5%, by weight.

Builder—The compositions according to the present invention may further comprise a builder system. Because builders such as citric acid and citrates impair the stability of enzymes in LDL compositions, it is desirable to include reduce the amounts or completely remove the builder salts normally utilized in LDL compositions incorporating propylene glycol as a builder. When a detergent composition includes propylene glycol solvent as a part or a whole of the detergent's carrier, enzymes are more stable and smaller amounts or no builder salts are needed.

If it is desirable to use a builder, then any conventional builder system is suitable for use herein including aluminosilicate materials, silicates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) $CH_2$(COOH) wherein R is $C_{10-20}$ alkyl or alkenyl, preferably $C_{12-16}$, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

If detergency builder salts are included, they will be included in amounts of from 0.5% to 50% by weight of the composition preferably from 5% to 30% and most usually from 5% to 25% by weight.

Enzymes—Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from about 0.0001% to about 5% of active enzyme by weight of the detergent composition. Preferred proteolytic enzymes, then, are selected from the group consisting of Alcalase® (Novo Industri A/S), BPN', Protease A and Protease B (Genencor), and mixtures thereof. Protease B is most preferred. Preferred amylase enzymes include TERMAMYL®, DURAMYL® and the amylase enzymes those described in WO 9418314 to Genencor International and WO 9402597 to Novo.

Further non-limiting examples of suitable and preferred enzymes are disclosed in the copending application: "Dishwashing Detergent Compositions Containing Organic Diamines for Improved Grease Cleaning, Sudsing, Low temperature stability and Dissolution", having P & G Case No. 7167P and application serial No. 60/087,693, which is hereby incorporated by reference.

Because hydrogen peroxide and builders such as citric acid and citrates impair the stability of enzymes in LDL compositions, it is desirable to reduce or eliminate the levels of these compounds in compositions which contain enzymes. Hydrogen peroxide is often found as an impurity in surfactants and surfactant pastes. As such, the preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide.

Magnesium Ions

While it is preferred that divalent ions be omitted from LDL compositions prepared according to the present invention, alternate embodiments of the present invention may include magnesium ions.

It is desirable to exclude all divalent ions from the present LDL compositions, because such ions may lead to slower dissolution as well as poor rinsing, and poor low temperature stability properties. Moreover, formulating such divalent ion-containing compositions in alkaline pH matrices may be difficult due to the incompatibility of the divalent ions, particularly magnesium, with hydroxide ions.

Nonetheless, the presence of magnesium ions offers several benefits. Notably, the inclusion of such divalent ions improves the cleaning of greasy soils for various LDL compositions, in particular compositions containing alkyl ethoxy carboxylates and/or polyhydroxy fatty acid amide. This is especially true when the compositions are used in softened water that contains few divalent ions.

But in the present invention, these benefits can be obtained without the inclusion of divalent ions. In particular, improved grease cleaning can be achieved without divalent ions by the inclusion of organic diamines in combination with amphoteric and anionic surfactants in the specific ratios discussed above while enzymes have been shown to improve the skin mildness performance of the present LDL compositions.

If they are to be included in an alternate embodiment of the present LDL compositions, then the magnesium ions are present at an active level of from about 0.01% to 1%, preferably from about 0.015% to 0.5%, more preferably from about 0.025% to 0.1%, by weight. The amount of magnesium ions present in compositions of the invention will be also dependent upon the amount of total surfactant present therein, including the amount of alkyl ethoxy carboxylates and polyhydroxy fatty acid amide.

Preferably, the magnesium ions are added as a hydroxide, chloride, acetate, sulfate, formate, oxide or nitrate salt to the compositions of the present invention. Because during storage, the stability of these compositions becomes poor due to the formation of hydroxide precipitates in the presence of compositions containing moderate concentrations of hydroxide ions, it may be necessary to add certain chelating agents. Suitable chelating agents are discussed further below and in U.S. Pat. No. 5,739,092, issued Apr. 14, 1998, to Ofosu-asante, incorporated herein by reference.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein can be found in the copending provisional patent application: "Dishwashing Detergent Compositions Containing Organic Diamines for Improved Grease Cleaning, Sudsing, Low temperature stability and Dissolution", having P & G Case No. 7167P, application serial No. 60/087,693, incorporated above.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilo-triacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST™ chelant. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perlins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from about 0.1% to about 15% by weight of the detergent compositions herein. More preferably, if utilized, the chelating agents will comprise from about 0.1% to about 3.0% by weight of such compositions.

Composition pH

Dishwashing compositions of the invention will be subjected to acidic stresses created by food soils when put to use, i.e., diluted and applied to soiled dishes. If a composition with a pH greater than 7 is to be more effective, it preferably should contain a buffering agent capable of providing a generally more alkaline pH in the composition and in dilute solutions. Dishwashing compositions of the present invention will thus contain from about 0.1% to 15%, preferably from about 1% to 10%, most preferably from about 2% to 8%, by weight, of a buffering agent. The pKa value of this buffering agent should be about 0.5 to 1.0 pH units below the desired pH value of the composition (determined as described above Preferably, the pKa of the buffering agent should be from about 7 to about 12. Under these conditions the buffering agent most effectively controls the pH while using the least amount thereof.

Preferred inorganic buffers/alkalinity sources include the alkali metal carbonates, alkali metal hydroxides and alkali metal phosphates, e.g., sodium carbonate, sodium hydroxide, sodium polyphosphate.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolaamine. The diamines, described in detail above, also act as buffering agents and are preferred buffering agents. Preferred buffering system for use in the present detergent compositions include a combination of 0.5% diamine and 2.5% citrate and a combination of 0.5% diamine, 0.75% potassium carbonate and 1.75% sodium carbonate. Other preferred nitrogen-containing buffering agents are Tri(hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Mixtures of any of the above are also acceptable. For additional buffers see McCutcheon's EMULSIFIERS AND DETERGENTS, North American Edition, 1997, McCutcheon Division, MC Publishing Company Kirk and WO 95/07971 both of which are incorporated herein by reference.

Other Ingredients—The detergent compositions will further preferably comprise one or more detersive adjuncts selected from the following: soil release polymers, polymeric dispersants, polysaccharides, abrasives, bactericides and other antimicrobials, tarnish inhibitors, builders, enzymes, dyes, buffers, antifungal or mildew control agents, insect repellents, perfumes, hydrotropes, thickeners, processing aids, suds boosters, brighteners, anti-corrosive aids, stabilizers antioxidants and chelants. A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbarnate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be a further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10™ hydrophobic silica) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified of otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Further, these hand dishwashing detergent embodiments preferably further comprises a hydrotrope. Suitable hydrotropes include sodium, potassium, ammonium or water-soluble substituted ammonium salts of toluene sulfonic acid, naphthalene sulfonic acid, cumene sulfonic acid, xylene sulfonic acid.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

The compositions of this invention can be used to form aqueous washing solutions for use hand dishwashing. Generally, an effective amount of such compositions is added to water to form such aqueous cleaning or soaking solutions. The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The following examples are illustrative of the present invention, but are not meant to limit or otherwise define its scope. All parts, percentages and ratios used herein are expressed as percent weight unless otherwise specified.

EXAMPLES

TABLE I

Light Duty Liquid dishwashing detergents of the present invention are as follows:

| | Example 1 |
|---|---|
| AE0.6S[1] | 26.1 |
| Amine oxide[2] | 6.5 |
| Citric acid | 2.6 |
| Suds boosting polymer[3] | 0.2 |
| Sodium Cumene | 3.50 |
| Sulfonate propylene glycol | 9.8 |
| Nonionic[4] | 3.0 |
| Diamine[5] | 0.50 |

TABLE I-continued

Light Duty Liquid dishwashing detergents of the present invention are as follows:

| | Example 1 |
|---|---|
| Water | BAL. |
| Total Active | 36% |
| Viscosity (cps @ 20° C.) | 780 |
| pH @ 10% | 9.0 |

[1]C12–13 alkyl ethoxy sulfonate containing an average of 0.6 ethoxy groups.
[2]$C_{12}$–$C_{14}$ Amine oxide.
[3]Polymer is (N,N-dimethylamino)ethyl methacrylate homopolymer
[4]Nonionic may he either C11 Alkyl ethoxylated surfactant containing 9 ethoxy groups or C10 Alkyl ethoxylated surfactant containing 8 ethoxy groups . . .
[5]1,3 bis(methylamine)-cyclohexane.

TABLE II

Light Duty Liquid dishwashing detergents of the present invention are as follows:

| | Example 2 | Example 3 | Example 4 | Example 5 | Example 6 |
|---|---|---|---|---|---|
| AE0.6S[1] | 26.1 | 26.1 | 26.1 | 13.05 | 26.1 |
| Amine oxide[2] | 6.5 | 6.5 | 6.5 | 3.25 | 5.5 |
| Nonionic[3] | 3 | 3 | 3 | 1.5 | 3 |
| Suds boosting polymer[4] | 0.2 | 0.2 | 0.2 | 0.1 | 0.2 |
| Diamine[5] | 0.5 | 0.5 | 0.5 | 0.25 | 0.5 |
| Sodium cumene sulphonate | 3.5 | 3.5 | 3.5 | 1.75 | 2.0 |
| sodium chloride | — | 0.5 | 0.5 | 0.25 | 0.6 |
| propylene glycol | 9.8 | — | 10.0 | 5.0 | — |
| polypropylene glycol | — | 1.0 | 1.0 | 0.5 | 1.0 |
| Citrate | 2.6 | — | — | — | — |
| $Mg^{2+}$ | — | — | — | — | 0.04 |
| Protease[6] | — | — | 0.015 | 0.0075 | — |
| Ethanol | — | 7.0 | 0.0 | 0.0 | 7.0 |
| Mole ratio anionic: amine oxide: diamine | 23:8:1 | 23:8:1 | 23:8:1 | 23:8:1 | 23:8:1 |
| pH @ 10% | 9 | 9 | 9 | 9 | 9 |

[1]C12–13 alkyl ethoxy sulfonate containing an average of 0.6 ethoxy groups.
[2]$C_{12}$–$C_{14}$ Amine oxide.
[3]Nonionic may be either C11 Alkyl ethoxylated surfactant containing 9 ethoxy groups or C10 Alkyl ethoxylated surfactant containing 8 ethoxy groups.
[4]Polymer is (N,N-dimethylamino)ethyl methacrylate homopolymer
[5]1,3 bis(methylamine)-cyclohexane.
[6]The protease is selected from: Savinase ®; Maxatase ®; Maxacal ®; Maxapem 15 ®; subtilisin BPN and BPN'; Protease B; Protease A; Protease D; Primase ®; Durazym ®; Opticlean ®; and Optimase ®; and Alcalase ®.

TABLE III

Light Duty Liquid dishwashing detergents of the present invention are as follows:

| | Example 7 | Example 8 | Example 9 | Example 10 |
|---|---|---|---|---|
| AE0.6S[1] | 26.09 | 26.09 | 26.09 | 28.80 |
| Amine oxide[2] | 6.50 | 6.5 | 8.0 | 8.0 |
| Suds boosting polymer[3] | 0.20 | 0.20 | 0.20 | 0.22 |
| Sodium Cumene Sulfonate | 3.50 | 3.50 | 3.50 | 3.90 |
| Nonionic[4] | 3.00 | 3.00 | 3.00 | 3.30 |
| Diamine[5] | 0.50 | 0.50 | 0.50 | 0.55 |

TABLE III-continued

Light Duty Liquid dishwashing detergents of the present invention are as follows:

| | Example 7 | Example 8 | Example 9 | Example 10 |
|---|---|---|---|---|
| Sodium Chloride | 1.5 | 1.5 | 1.5 | 1.5 |
| NaOH | 0.35 | 0.35 | 0.35 | 0.35 |
| $Na_2CO_3$ | 1.75 | 1.75 | 1.75 | 1.75 |
| $K_2CO_3$ | 0.75 | 0.75 | 0.75 | 0.75 |
| propylene glycol | 4.0 | 4.0 | 4.0 | 4.0 |
| polypropylene glycol | 1.0 | 1.0 | 1.0 | 1.0 |
| Ethanol | 3.0 | 0.7 | 0.7 | — |
| Water and Misc. | BAL. | BAL. | BAL. | BAL. |
| Viscosity (cps @ 70 F.) | 353 | 640 | 635 | 848 |
| pH @ 10% | 10.8 | 10.8 | 10.80 | 10.8 |

[1]C12–13 alkyl ethoxy sulfonate containing an average of 0.6 ethoxy groups.
[2]$C_{12}$–$C_{14}$ Amine oxide.
[3]Polymer is (N,N-dimethylamino)ethyl methacrylate homopolymer
[4]Nonionic may be either C10 Alkyl ethoxylated surfactant containing 8 ethoxy groups or C10 Alkyl ethoxylated surfactant containing 8 ethoxy groups.
[5]1,3 bis(methylamine)-cyclohexane

What is claimed is:

1. A liquid dishwashing detergent composition suitable for use in hand dishwashing, said composition comprising:

(a) a low molecular weight organic diamine having a pK1 and a pK2, wherein the pK1 and the pK2 of said diamine are both in the range of from 8.0 to 115;

(b) an anionic surfactant;

(c) an amphoteric surfactant, (d) a solvent selected from the group consisting of a diol, a polymeric glycol, and mixtures thereof, wherein said diol is represented by the formula:

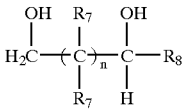

wherein n=0–3, $R_7$=H, methyl or ethyl; and $R_8$=H, methyl, ethyl, propyl, isopropyl, butyl and isobutyl; and wherein the polymeric glycol is represented by the formula:

$$(PO)_x(EO)_yH$$

wherein PO represents a propylene oxide group and EO represents an ethylene oxide group and x+y is from 17 to 68, and x/(x+y) is from 0.25 to 1.0;

wherein the pH as measured as 10% aqueous solution is from 5.0 to 12.5; and wherein the mole ratio of said anionic surfactant to said amphoteric surfactant to said diamine is from 100:40:1 to 9:05:1.

2. A liquid dishwashing detergent composition according to claim 1 further comprising a buffering agent and wherein the composition has a pH of from 10 to 11.5.

3. A liquid dishwashing detergent composition according to claim 2 wherein the diol is selected from the group consisting of propylene glycol, 1,2 hexandiol, 2-ethyl-1,3-hexanediol and 2,2,4trimethyl-1,3-pentanediol and mixtures thereof.

4. A liquid dishwashing detergent composition according to claim 3 wherein the polymeric glycol is polypropylene glycol having a molecular weight of from 1000 to 5000.

5. A liquid dishwashing detergent composition according to claim 4 wherein said diamine is represented by the formula:

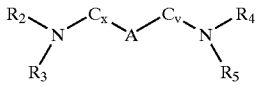

wherein $R_{2-5}$ are independently selected from H, methyl, ethyl, and ethylene oxides; $C_x$ and $C_y$ are independently selected from methylene groups or branched alkyl groups where x+v is from 3 to 6; and A is optionally present and is selected from electron donating or withdrawing moieties chosen to adjust the diamine pKa's to the desired range; wherein if A is present, then both x and y must be 2 or greater.

6. A liquid dishwashing detergent composition according to claim 5 wherein the polymeric glycol is polypropylene glycol having a molecular weight of from 2000 to 4000 and is present in a range of from 0.25% to 5.0%, by weight of the composition.

7. A liquid dishwashing detergent composition according to claim 6 further comprising a polymeric suds stabilizer selected from the group consisting of:

(a) homopolymers of (N,N-dialkylamino)alkyl acrylate esters having the formula:

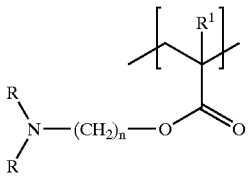

wherein each R is independently hydrogen, $C_1$–$C_8$ alkyl, and mixtures thereof, $R^1$ is hydrogen, $C_{1-6}$ alkyl, and mixtures thereof, n is from 2 to 6; and (b) copolymers of (a) and

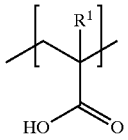

wherein $R^1$ is hydrogen, C1–C6 alkyl, and mixtures thereof; provided that the ratio of (b) to (a) is from 2 to 1 to 1 to 2; and (c) mixtures thereof:

wherein said polymeric suds stabilizer has a molecular weight of from 1,000 to 2,000,000 daltons.

8. The liquid dishwashing detergent composition according to claim 7 further comprising α-amylases.

9. A method for cleaning a substrate in a manual dishwashing operation comprising the steps of:

(a) contacting the substrate with a liquid dishwashing detergent composition of claim 1; and (b) allowing the detergent composition to remain in contact with the substrate for a sufficient time to provide cleaning benefits to the substrate.

10. A method according to claim 9, wherein the liquid dishwashing detergent composition is applied to the substrate with no more than 90% dilution with water.

11. The liquid dishwashing composition according to claim 1, wherein the solvent is a diol and wherein the diol is represented by the formula:

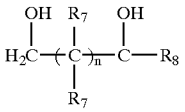

wherein n=0–3, $R_7$=H methyl or ethyl; and $R_8$=H, methyl ethyl, propyl, isopropyl, butyl and isobutyl.

12. The liquid dishwashing composition according to claim 1, wherein the polymeric glycol is polypropylene glycol.

13. The liquid dishwashing composition according to claim 1, wherein the composition comprises from about 0.1% to about 20% by weight of the composition of amphoteric surfactant.

14. The liquid dishwashing composition according to claim 1, wherein the composition comprises from about 5% to about 50% by weight of the composition of anionic surfactant.

15. The liquid dishwashing composition according to claim 1, wherein the composition comprises from about 0.1% to about 5% by weight of the composition of diamine, which has a molecular weight of less than or equal to 400 g/mol.

16. The liquid dishwashing composition according to claim 1, wherein the composition comprises from about 0.5% to about 25.0% by weight of the composition of solvent.

17. A liquid dishwashing detergent composition suitable for use in hand dishwashing, said composition comprising:

(a) from 0.1% to about 5% by weight of a low molecular weight organic diamine having a molecular weight of less than or equal to 400 g/mol and a pK1 and a pK2, wherein the pK1 and pK2 of said diamine are both in the range of from 8.0 to 11.5;

(b) from about 5% to about 50% by weight of an anionic surfactant;

(c) from about 0.1% to about 20% by weight of an amphoteric surfactant; and (d) from about 0.50% to about 25.0% by weight of a polypropylene glycol solvent, wherein the pH as measured as a 10% aqueous solution is from about 5.0 to about 12.5, and the mole ratio of said anionic surfactant to said amphoteric surfactant to said diamine is from about 100:40:1 to about 9:0.5:1.

18. The liquid dishwashing composition according to claim 1, wherein when said solvent is a polymeric glycol, and said composition further comprises at least one of the following: a diol or alkali metal inorganic salt.

19. The liquid dishwashing composition according to claim 17, wherein said composition further comprises at least one of the following: a diol or alkali metal inorganic salt.

* * * * *